US006471497B2

(12) United States Patent
Suzuki et al.

(10) Patent No.: US 6,471,497 B2
(45) Date of Patent: Oct. 29, 2002

(54) GAS SUPPLYING DEVICE FOR VACUUM PUMP

(75) Inventors: Yoshinari Suzuki; Naoki Goto; Mamoru Kuwahara, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/841,742

(22) Filed: Apr. 25, 2001

(65) Prior Publication Data

US 2002/0004016 A1 Jan. 10, 2002

(30) Foreign Application Priority Data

Apr. 26, 2000 (JP) ..... 2000-125272

(51) Int. Cl.[7] ..... F03C 2/00
(52) U.S. Cl. ..... 418/9; 418/15; 137/597
(58) Field of Search ..... 418/15, 9; 137/597

(56) References Cited

U.S. PATENT DOCUMENTS 3,512,553 A * 5/1970 Legris ..... 137/597
4,544,333 A * 10/1985 Hirano ..... 418/201.2
5,046,934 A * 9/1991 Berges ..... 418/15
5,049,050 A * 9/1991 Berges et al. ..... 418/15
5,082,427 A * 1/1992 Fujiwara et al. ..... 418/15
5,277,224 A * 1/1994 Hutton et al. ..... 137/597
5,356,275 A * 10/1994 Brenner et al. ..... 418/15

FOREIGN PATENT DOCUMENTS

| | | |
|---|---|---|
| JP | 5-99181 | 4/1993 |
| JP | 5-118286 | 5/1993 |
| JP | 6-79159 | 3/1994 |
| JP | 10-252651 | 9/1998 |

* cited by examiner

*Primary Examiner*—Thomas Denion
*Assistant Examiner*—Theresa Trieu
(74) *Attorney, Agent, or Firm*—Woodcock Washburn LLP

(57) ABSTRACT

Fixed throttle devices 36A, 36B, 36C, 36D are screw-engaged with a rotor housing 12. A fixed throttle device 37is screw-engaged with a front housing 13, and a fixed throttle device 38is screw-engaged with a rear housing 14. Inert gas is supplied to the respective throttle devices 36A, 36B, 36C, 36D, 37and 38via branch pipes 54 to 59. Each of the throttle devices 36A, 36B, 36C, 36D, 37and 38includes a check valve 44, a fixed throttle 45 screw-engaged with the check valve 44, and a pipe joint 46 screw-engaged with the check valve 44.

2 Claims, 4 Drawing Sheets

GAS SUPPLYING DEVICE FOR VACUUM PUMP

BACKGROUND OF THE INVENTION

1. Field of the Invention

The present invention relates to a gas supplying device, for a vacuum pump for carrying out a gas sucking operation due to the transfer motion of a gas transferring body, wherein a gas, other than the process gas to be transferred by the transfer motion of the gas transferring body, is supplied to an area in which the process gas exists.

2. Description of the Related Art

In a vacuum pump disclosed in Japanese Unexamined Patent Publication (Kokai) No. 5-118286, a plurality of pairs of rotors, each meshed with another, are made to rotate. The rotational motion of the plurality of meshed rotors transfers process gas. The process gas such as perfluorocarbon (PFC) gas tends to solidify under high pressure or deteriorate due to a chemical reaction with lubricant in the pump. To solve such a problem, an inert gas such as nitrogen gas is often supplied into a passage of the process gas to dilute the same.

In Kokai No. 5-118286, an arrangement is disclosed wherein a needle valve or a fixed throttle device is provided in a passage for supplying inert gas. The needle valve is capable of adjusting a feed rate of the inert gas. The feed rate of the inert gas in a device using the fixed throttle is adjustable by selecting a proper fixed throttle device having a necessary gas feeding capacity.

When the pressure of the process gas becomes higher than that of the inert gas to be fed, the process gas may enter the supply passage of the inert gas. The ingress of the process gas may damage a device for supplying the inert gas. Thus, it is preferable to provide a check valve in the supply passage of the inert gas to prevent the waste gas from entering. This counter measure, however, is problematic in that many check valves corresponding to the number of needle valves or fixed throttle devices are necessary because each of the needle valves or fixed throttle devices requires one check valve, respectively. Accordingly, the arrangement wherein the check valves are merely provided in the supply passage of the inert gas results in an increase in the size of the vacuum pump.

SUMMARY OF THE INVENTION

An object of the present invention is to prevent the size of a vacuum pump from increasing when a function of a check valve is incorporated into a supply passage for inert gas.

For this purpose, according to one aspect of the present invention, a gas supplying device, for a vacuum pump for carrying out a gas sucking operation due to the transfer motion of a gas transferring body, supplies a first gas, different from the second gas to be transferred by the transfer motion of the gas transferring body to an area of the vacuum pump in which the second gas exists, wherein a fixed flow rate restriction means for restricting the fixed flow rate of the first gas is provided in a passage for supplying the other gas.

The fixed flow rate restriction means prevents the second gas from entering the supply passage of the first gas. The fixed flow rate restriction means is effective for suppressing an increase in the size of the vacuum pump.

According to another aspect of the present invention, there are a plurality of the supply passages, each connected to the area in which the second gas exists, and the fixed flow rate restriction means are selectively provided in the respective supply passages, for supplying proper amounts of the first gas per unit time to the area.

The fixed flow rate restriction means for supplying a proper amount of gas can be easily manufactured. The fixed flow rate restriction means is easily selectable so that a predetermined amount of gas is supplied to the area in which the second gas exists.

According to a further aspect of the present invention, a threaded hole for supplying the first gas is formed in a housing of the vacuum pump as part of the supply passage, and the fixed flow rate restriction means is screw-engaged in the threaded hole.

The arrangement, in which the fixed flow rate restriction means is attached to the housing by the screw-engagement, is simple in structure.

According to a further aspect of the present invention, the fixed flow rate restriction means is a check valve and a fixed throttle having an orifice, which is screw-engaged with the check valve wherein the check valve is disposed upstream of the fixed throttle.

The fixed flow rate restriction means including the check valve and the fixed throttle having the orifice to form a unit can be assembled by using a standardized check valve and fixed throttle available on the market.

According to still further aspect of the present invention, the vacuum pump is a multi-stage Roots pump in which a plurality of rotary shafts, each provided with rotors thereon, are arranged in parallel to each other so that the rotors on one shaft are meshed with those on the adjacent shaft, and pump chambers, each accommodating one set of the meshed rotors therein, are defined in the housing to be arranged in the axial direction of the rotary shafts.

The present invention is suitably applied to a multi-stage Roots pump.

The present invention may be more fully understood from the description of the preferred embodiments of the invention set forth below together with the accompanying drawings.

BRIEF DESCRIPTION OF THE DRAWINGS

In the drawings:

FIGS. 1A and 1B illustrate a gas supplying device of a vacuum pump according to a first embodiment of the present invention, wherein FIG. 1A is a sectional view thereof and FIG. 1B is a sectional view of a fixed throttle device;

DESCRIPTION OF THE PREFERRED EMBODIMENTS

A first embodiment of the present invention applied to a multi-stage Roots pump will be described below with reference to FIGS. 1A to 5.

Figure 1B:
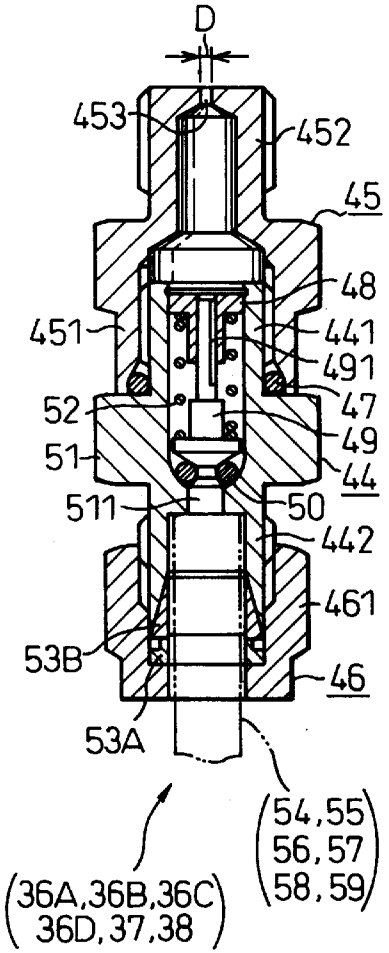
Figure 1A:
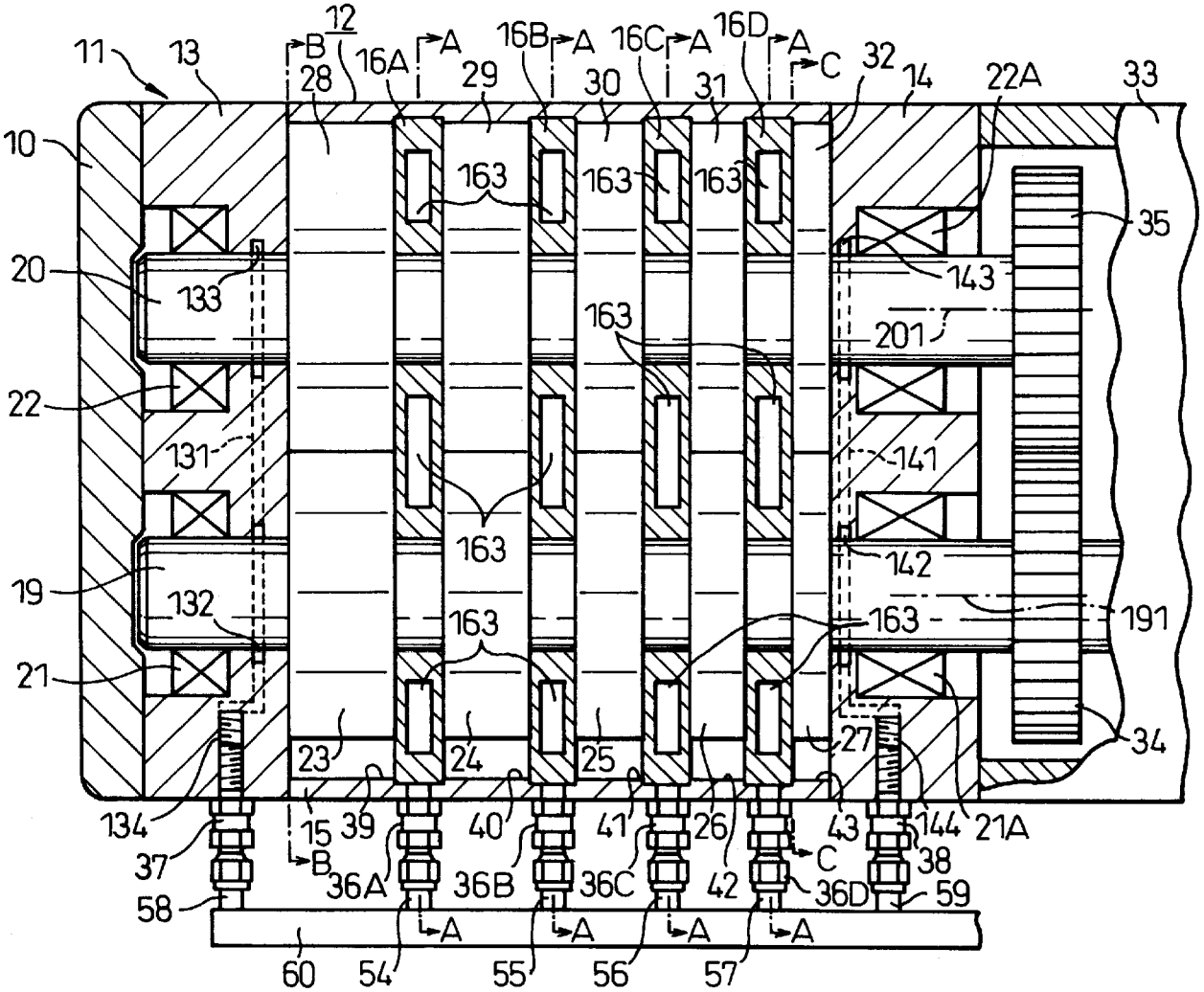
Figure 2:
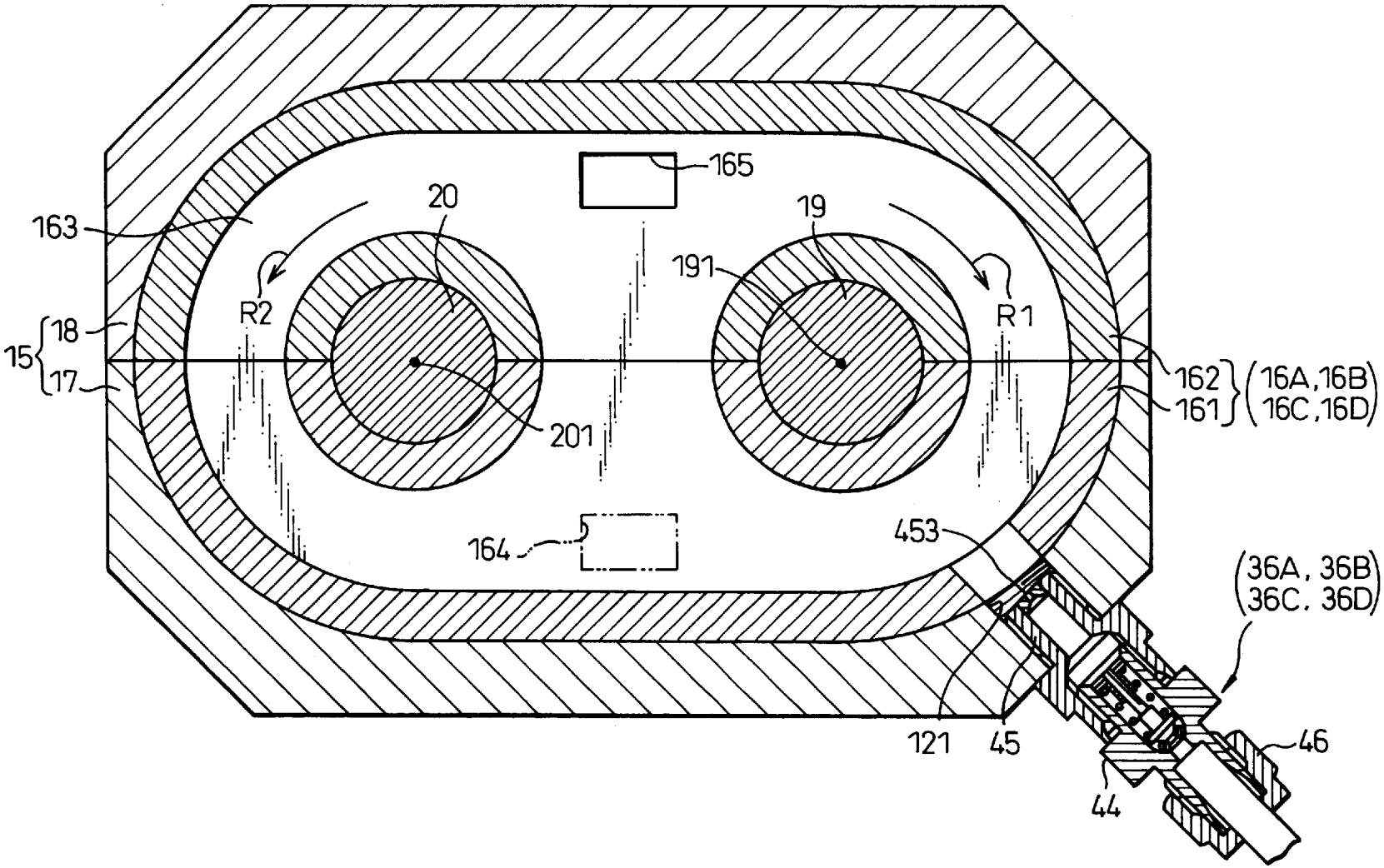
FIG. 2 is a sectional view taken along a line A—A in FIG. 1A.

As shown in FIG. 1A, a front housing 13 is fixedly attached to a front end of a rotor housing 12 of a multi-stage Roots pump 11, and a sealing body 10 is attached to the front housing 13. To a rear end of the front housing 13, a rear housing 14 is attached. The rotor housing 12 consists of a cylinder block 15 and a plurality of partitioning walls 16A, 16B, 16C and 16D. As shown in FIG. 2, the cylinder block 15 consists of a pair of block halves 17, 18, and each of the partitioning walls 16A, 16B, 16C and 16D consists of a pair of wall halves 161, 162. As shown in FIG. 1A, spaces between the front housing 13 and the partitioning wall 16A, between the adjacent two partitioning walls 16A, 16B, 16C and 16D and between the rear housing 14 and the partitioning wall 16D define pump chambers 39, 40, 41, 42 and 43, respectively.

A pair of rotary shafts 19, 20 are supported in a rotatable manner by the front housing 13 and the rear housing 14 via radial bearings 21, 21A, 22 and 22A. The rotary shafts 19, 20 are arranged in parallel to each other. The rotary shafts 19, 20 penetrate the partitioning walls 16A, 16B, 16C and 16D.

The rotary shaft 19 has a plurality of rotors 23, 24, 25, 26 and 27 formed integrally therewith, while the rotary shaft 20 has a plurality of rotors 28, 29, 30, 31 and 32 (the same number as the former) formed integrally therewith. The rotors 23 to 32 are of the same shape and size as seen in the axial direction 191, 201 of the rotary shafts 19, 20. On the other hand, the rotors 23, 24, 25, 26 and 27 become smaller in thickness in this order, while the rotors 28, 29, 30, 31 and 32 become smaller in thickness in this order. The rotors 23 and 28 are accommodated in the pump chamber 39 in a relatively meshed state, and the rotor 24 and 29 are accommodated in the pump chamber 40 in a relatively meshed state. The rotors 25 and 30 are accommodated in the pump chamber 41 in a relatively meshed state, and the rotor 26 and 31 are accommodated in the pump chamber 42 in a relatively meshed state. The rotors 27 and 32 are accommodated in the pump chamber 43 in a relatively meshed state.

A drive section 33 is assembled to the rear housing 14. The rotary shafts 19, 20 penetrate the rear housing 14 and project into the drive section 33. Gears 34, 35 are fixedly secured to the projected ends of the rotary shafts 19, 20, respectively, in a relatively meshed state. The rotary shaft 19 is made to rotate by a motor not shown in the drive section 33 in the arrowed direction R1 shown in FIGS. 2 to 4. The rotation of the rotary shaft 19 is transmitted via the gears 34, 35 to the rotary shaft 20 to rotate the latter in reverse to the rotary shaft 19 in the arrowed direction R2 shown in FIGS. 2 to 4.

As shown in FIGS. 1A and 2, passages 163 are provided in the partitioning walls 16A, 16B, 16C and 16D, respectively. As shown in FIG. 2, an inlet 164 and an outlet 165 for the passage 163 are formed in each of the partitioning walls 16A, 16B, 16C and 16D. The pump chambers 39, 40, 41, 42 and 43 adjacent to each other communicate with each other via the passage 163.

Figure 3:
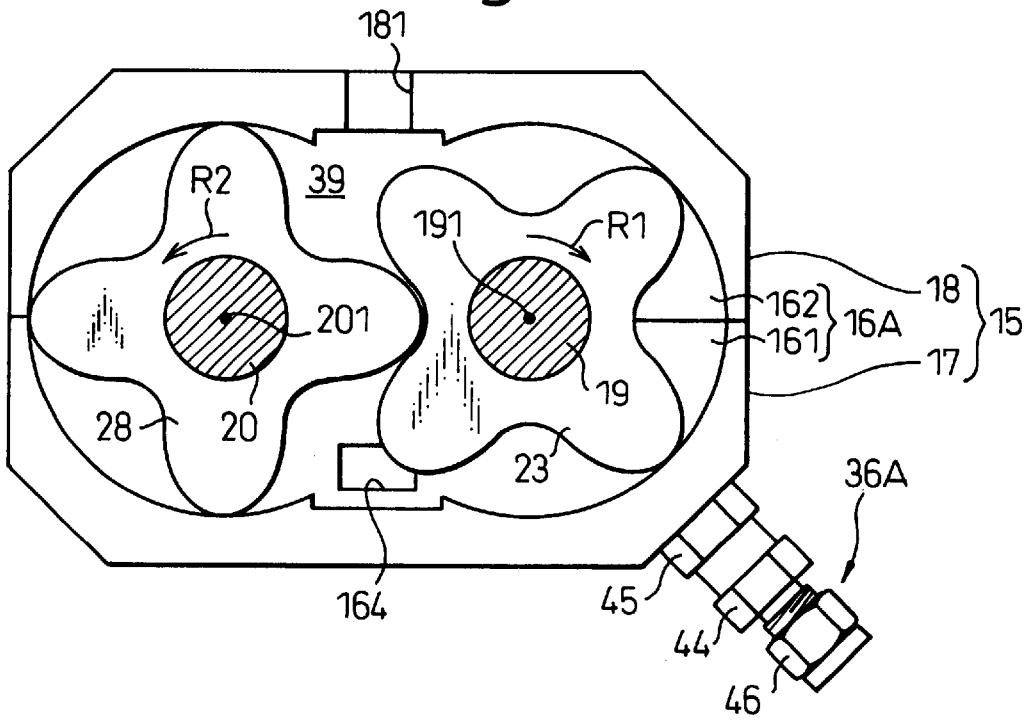
FIG. 3 is a sectional view taken along a line B—B in FIG. 1A.
Figure 4:
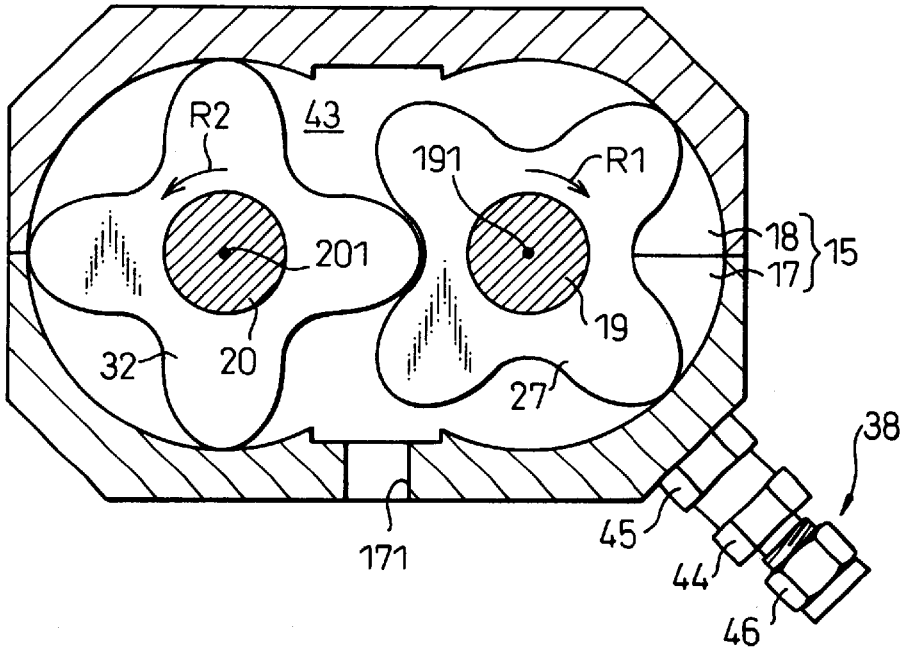
FIG. 4 is a sectional view taken along a line C—C in FIG. 1A.

As shown in FIG. 3, the block half 18 has a gas introduction opening 181 for communication with the pump chamber 39. As shown in FIG. 4, the block half 17 has a gas discharge opening 171 for communication with the pump chamber 43. Gas introduced into the pump chamber 39 through the gas introduction opening 181 is transferred to the adjacent pump chamber 40 from the outlet 165 via the inlet 164 of the partitioning wall 16A due to the rotation of the rotors 23, 28. In a similar manner, gas is sequentially transferred to the adjacent pump chamber having a smaller volume, that is, in the order of the pump chambers 40, 41, 42 and 43. Gas finally transferred to the pump chamber 43 is discharged outside from the gas discharge opening 171. The rotors 23 to 32 constitute a gas transferring body.

As shown in FIG. 1A, a plurality of fixed throttle devices 36A, 36B, 36C and 36D are screw-engaged in the rotor housing 12. As shown in FIG. 2, a plurality of threaded holes 121 are formed in the rotor housing 12, in which are screw-engaged the fixed throttle devices 36A, 36B, 36C and 36D, respectively. The threaded holes 121 communicate with the passages 163 of the partitioning walls 16A, 16B, 16C and 16D, respectively.

As shown in FIG. 1A, a threaded hole 134 is formed in the front housing 13, and a fixed throttle device 37 is screw-engaged therein. A threaded hole 144 is formed in the rear housing 14, and a fixed throttle device 38 is screw-engaged therein. Branch pipes 54, 55, 56, 57, 58 and 59 are connected on one hand to the fixed throttle devices 36A, 36B, 36C, 36D, 37 and 38, respectively, and on the other hand to a main pipe 60. The main pipe 60 is connected to a gas supply source not shown. Inert gas (such as nitrogen gas) in the gas supply source is supplied to the respective fixed throttle devices 36A, 36B, 36C, 36D, 37 and 38 via the main pipe 60 and the branch pipes 54 to 59.

Figure 5:
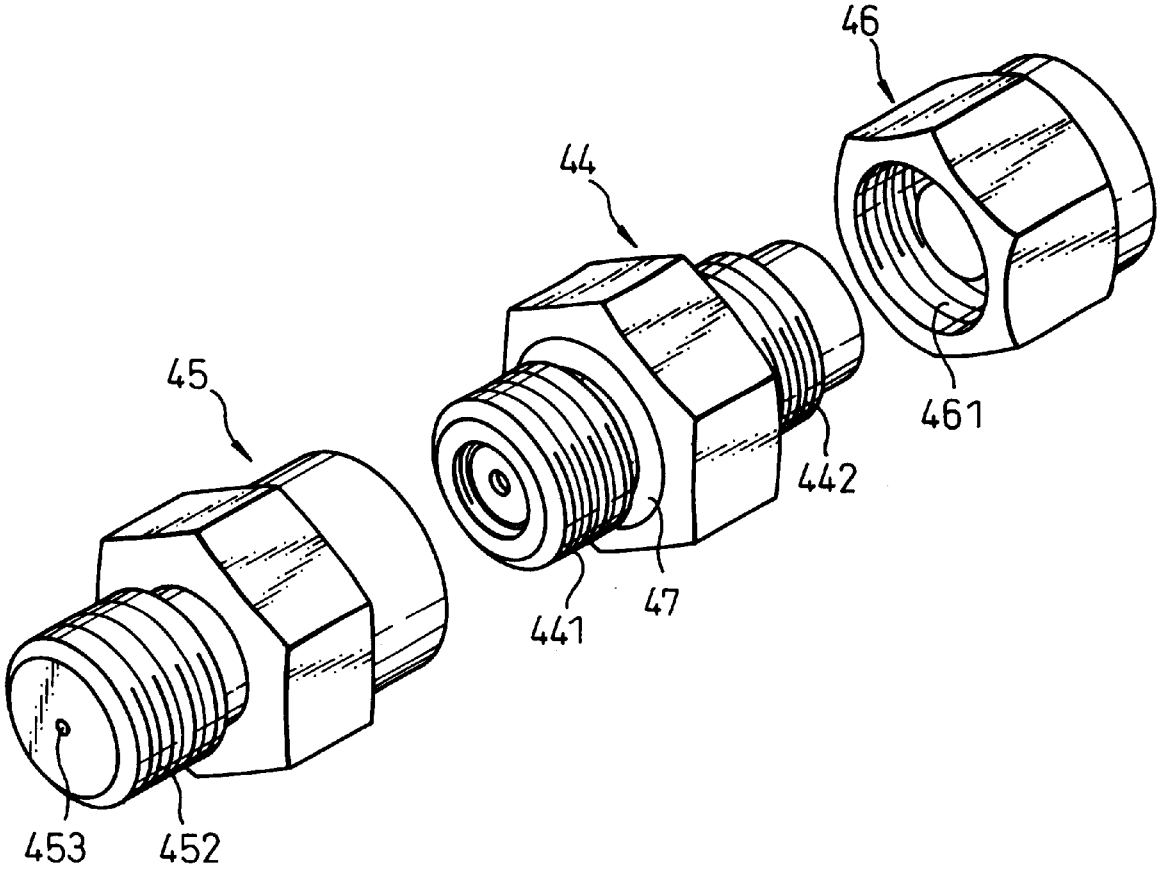
FIG. 5 is an exploded perspective view of main components of a gas supplying device of a vacuum pump according to the present invention.

As shown in FIG. 1B, the fixed throttle device 36A consists of a check valve 44, a fixed throttle 45 screw-engaged over a male thread portion 441 of the check valve 44 via a female thread portion 451 of the former, and a pipe joint 46 screw-engaged over a male thread portion 442 of the check valve 44 via a female thread portion 461 of the former. A seal ring is interposed between the check valve 44 and the fixed throttle 45. An orifice 453 is formed at a tip end of the fixed throttle 45. The tip end of the fixed throttle 45 is provided with a male thread portion 452, and the fixed throttle device 36A is fixed by the screw-engagement of the male thread portion 452 with the threaded hole 121. FIG. 5 shows one of the fixed throttle devices 36A, 36B, 36C, 36D, 37 and 38 disassembled into the check valve 44, the fixed throttle 45 and the pipe joint 46. The check valve 44 is arranged at a position upstream of the fixed throttle 45.

As shown in FIG. 1B, the check valve 44 includes a housing 51 having a valve hole 511, a guide 48 also used as a spring seat, a valve support 49 guided by the guide 48 in a slidable manner, a ring-shaped elastic member 50 made of rubber and attached to the valve support 49, and a spring 52 for biasing the valve support 49 toward the valve hole 511. A passage groove 491 is formed in the valve support 49. The branch pipe 54 is engaged into the check valve 44.

The pipe joint 46 includes a pair of seal rings 53A, 53B made of rubber. When the pipe joint 46 is fastened to the check valve 44, the seal ring 53A is resiliently deformed on one hand between the pipe joint 46 and the branch pipe 54, and the seal ring 53B is resiliently deformed on the other hand between the check valve 44 and the branch pipe 54. Thereby, the branch pipe 54 is prevented from coming off from the fixed throttle device 36A, due to the resilient deformation of the seal rings 53A and 53B.

The other fixed throttle devices 36B, 36C, 36D, 37 and 38 have the same structure as that of the fixed throttle device 36A. Inert gas delivered to the fixed throttle devices 36A, 36B, 36C, 36D, 37 and 38 passes through the valve hole 511 while pushing away the elastic member 50 against the elasticity of the spring 52. The inert gas passing through the valve hole 511 is introduced into the fixed throttle 45 via the passage groove 491. The inert gas entering the interior of the fixed throttle 45 then passes through the orifice 453.

As shown in FIG. 1A, a passage 131 in the front housing 13 is connected to the threaded hole 134 into which the fixed throttle device 37 is screw-engaged. The passage 131 communicates with annular passages 132, 133 formed around the rotary shafts 19, 20. The passages 132, 133 are provided between the radial bearings 21, 22 and the rotor 23, 28.

A passage 141 in the rear housing 14 is connected to the threaded hole 144 into which the fixed throttle device 38 is screw-engaged. The passage 141 communicates with annular passages 142, 143 formed around the rotary shafts 19, 20. The passages 142, 143 are provided between the radial bearings 21A, 22A and the rotor 27, 32.

The inert gas (first gas) delivered to the fixed throttle device 36A through the main pipe 60 and the branch pipe 54 is further delivered to the passage 163 in the partitioning wall 16A. The inert gas delivered to the fixed throttle device 36B via the main pipe 60 and the branch pipe 55 is further delivered to the passage 163 in the partitioning wall 16B. The inert gas delivered to the fixed throttle device 36C via the main pipe 60 and the branch pipe 56 is further delivered to the passage 163 in the partitioning wall 16C. The inert gas delivered to the fixed throttle device 36D via the main pipe 60 and the branch pipe 57 is further delivered to the passage 163 in the partitioning wall 16D. The inert gas delivered to the respective passages 163 dilutes the process gas (such as perfluorocarbon (PFC) gas) (second gas) in the passages 163.

The inert gas delivered to the fixed throttle device 37 via the main pipe 60 and the branch pipe 58 is delivered further to the passages 131, 132 and 133. The inert gas delivered to the passages 132 and 133 dilutes the process gas which tends to enter the radial bearings 21, 22 through the gap between the rotary shafts 19, 20 and the front housing 13.

The inert gas delivered to the fixed throttle device 38 via the main pipe 60 and the branch pipe 59 is delivered further to the passages 141, 142 and 143. The inert gas delivered to the passages 142 and 143 dilutes the process gas which tends to enter the radial bearings 21A, 22A through the gap between the rotary shafts 19, 20 and the rear housing 14.

The first embodiment results in the following effects:

(1) Although the supply pressure of the inert gas, that is, the interior pressure of the main pipe 60 and the branch pipe 54 to 59, is selected to be higher than an expected pressure in the passages 163 within the partitioning walls 16A, 16B, 16C and 16D and that in the passages 132, 133, 142 and 143, there is a risk that the pressure in the passage 163 or the passages 132, 133, 142 and 143 may become higher than the supply pressure of the inert gas. The check valve 44 prevents the ingress of the process gas into the branch pipes 54 to 59. The fixed throttle devices 36A, 36B, 36C, 36D, 37 or 38 in which the check valve 44 and the fixed throttle 45 are combined to form a single unit constitutes a fixed flow rate restriction means having a function of inhibiting the back flow for preventing the ingress of the process gas into the supply passage for inert gas consisting of the branch pipes 54 to 59 and the main pipe 60. The check valve 44 prevents the ingress of the process gas into the branch pipes 54 to 59. The fixed throttle devices 36A, 36B, 36C, 36D, 37 or 38 in which the check valve 44 and the fixed throttle 45 are combined to form a single unit is more compact than the prior art arrangement in which a piping is interposed between the check valve and the fixed throttle. Accordingly, the fixed throttle devices 36A, 36B, 36C, 36D, 37 or 38 having a function for inhibiting the back flow is effective for preventing the vacuum pump from enlarging in size.

(2) The pressure in the passages 163 of the respective partitioning walls 16A, 16B, 16C and 16D, the pressure in the passages 132, 133 and the pressure in the passages 142, 143 are different from each other. Accordingly, the concentrations of the process gas in the passages 163 in the respective partitioning walls 16A, 16B, 16C and 16D, in the passages 132, 133 and in the passages 142, 143 are different from each other. This means that proper amounts of inert gas to be supplied per unit time to the respective areas are different from each other. The areas are the passages 163 in the respective partitioning walls 16A, 16B, 16C and 16D, the passages 132, 133 and the passages 142, 143 wherein the process gas exists. The fixed throttle devices 36A, 36B, 36C, 36D, 37 and 38 are selected to deliver the proper amounts of inert gas per unit time to the respective areas in which the process gas exists. In other words, a diameter D of the orifice 453 (shown in FIG. 1B) of the fixed throttle devices 36A, 36B, 36C, 36D, 37 or 38 is selected to result in the proper amount of inert gas to be supplied with reference to the pressure in the supply passage constituted by the branch pipes 54 to 59 and the main pipe 60, the pressure in the areas in which the process gas exists or others. Such a diameter of the orifice 453 resulting in the proper gas supply amount can be easily calculated if the gas supply pressure and the pressure in the area in which the process gas exists are known. Therefore, the fixed throttle device 36A, 36B, 36C, 36D, 37 or 38 resulting in the proper gas supply amount can be easily manufactured and readily selected.

(3) The fixed throttle devices 36A, 36B, 36C, 36D, 37 and 38 are screw-engaged in the threaded holes 121, 134 and 144 formed in the housings 12, 13 and 14 as part of the inert gas supply passage. The attachment of the fixed throttle devices 36A, 36B, 36C, 36D, 37 and 38 to the housings 12, 13 and 14 by screw engagement is simple and easy.

(4) The check valve 44 and the fixed throttle 45 are available on the market as a standardized article, which is advantageous in regard to the total cost of the device.

(5) The multi-stage Roots pump 11 has a plurality of areas in which the process gas exists (that is, the passages 163 in the partitioning walls 16A, 16B, 16C and 16D and the annular passages 132, 133, 142 and 143) requiring different amounts of inert gas to be supplied thereto. The present invention is suitably applicable to such a multi-stage Roots pump 11 because the fixed throttle devices 36A, 36B, 36C, 36D, 37 and 38 selected to supply a suitable amount of inert gas to the areas are provided in the branch pipes 54 to 59, respectively.

Figure 6:
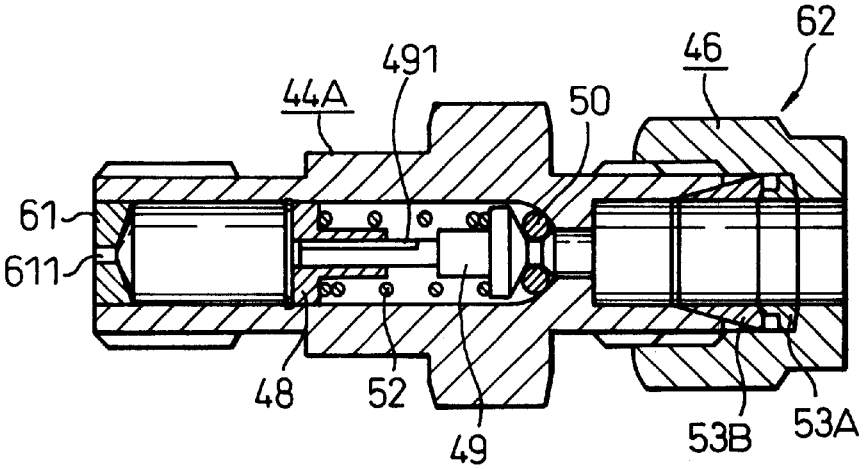
FIG. 6 is a sectional view of a main part of a gas supplying device of a vacuum pump according to a second embodiment of the present invention.

Next, a second embodiment shown in FIG. 6 will be described below, wherein the same reference numerals are used for denoting the same or similar components as in the first embodiment.

In a fixed throttle device 62 of this embodiment, a disk-shaped fixed throttle 61 having an orifice 611 is press-fit into a tube of a check valve 44A. This fixed throttle device 62 is more compact in size than the fixed throttle devices 36A, 36B, 36C, 36D, 37 and 38 in the first embodiment.

The present invention also includes the following aspects:

In the first embodiment, inert gas may be supplied from different fixed throttle devices to the annular passages 132, 133, and from other different fixed throttle devices to the annular passages 142, 143.

In the first embodiment, a labyrinth seal may be used in place of the annular passages 132, 133, 142 and 143.

The present invention may be applied to vacuum pumps other than the Roots pump.

As described in detail, according to the present invention, since the fixed flow rate restriction means having a function for inhibiting the back flow is incorporated in the gas supply passage, an increase in size of the vacuum pump can be restricted in comparison with a case wherein the check valve is provided in the gas supply passage.

While the invention has been described by reference to specific embodiments chosen for purposes of illustration, it should be apparent that numerous modifications could be made thereto, by those skilled in the art, without departing from the basic concept and scope of the invention.

What is claimed is:

1. A gas supplying device for a vacuum pump, for carrying out a gas sucking operation due to the transfer motion of a gas transferring body, and for supplying a first gas different from a second gas, to be transferred by the transfer motion of the gas transferring body, to an area of the vacuum pump in which the second gas exists, comprising:

a plurality of gas supplying passages for supplying the first gas, each connected to an area in which the second gas exists;

a fixed flow restriction means for restricting the fixed flow rate of the first gas, and for inhibiting the second gas from the flowing into the restriction means, selectively provided in the respective supply passages for supplying proper amounts of the first gas per unit time to the areas in which the second gas exists, wherein the fixed flow rate restriction means comprises a check valve and a fixed throttle, having an orifice, screw-engaged with the check valve wherein the check valve is disposed upstream of the fixed throttle and closes the supply passage for supplying the first gas due to a differential pressure between a pressure of the first gas and a pressure of the second gas when the pressure of the second gas is higher than that of the first gas; and a threaded hole for supplying the first gas, the threaded hole being formed in a housing of the vacuum pump as part of the supply passage, the fixed flow rate restriction means being screw-engaged in the threaded hole.

2. A gas supplying device for a vacuum pump according to claim 1, wherein the vacuum pump is a multi-stage Roots pump in which a plurality of rotary shafts, each provided with rotors thereon, are arranged in parallel to each other so that the rotors on one shaft are meshed with those on the adjacent shaft, and pump chambers, each accommodating one set of the meshed rotors therein, are defined in the housing to be arranged in the axial direction of the rotary shafts.

* * * * *